US011049459B2

(12) United States Patent
Kim

(10) Patent No.: US 11,049,459 B2
(45) Date of Patent: Jun. 29, 2021

(54) LIGHT-EMITTING DISPLAY AND METHOD OF DRIVING THE SAME

(71) Applicant: LG Display Co., Ltd., Seoul (KR)

(72) Inventor: Sunyoon Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/690,648

(22) Filed: Nov. 21, 2019

(65) Prior Publication Data

US 2020/0184902 A1 Jun. 11, 2020

(30) Foreign Application Priority Data

Dec. 10, 2018 (KR) ..... 10-2018-0158336

(51) Int. Cl.
*G09G 3/3291* (2016.01)

(52) U.S. Cl.
CPC ... *G09G 3/3291* (2013.01); *G09G 2300/0847* (2013.01); *G09G 2330/00* (2013.01)

(58) Field of Classification Search
CPC ..... G09G 3/3291; G09G 2330/00; G09G 2300/0847
See application file for complete search history.

(56) References Cited

U.S. PATENT DOCUMENTS

2014/0084792 A1 3/2014 Oh et al.
2017/0061871 A1* 3/2017 Xiang ..... G09G 3/3233
2019/0128932 A1* 5/2019 Fernandez ..... H03F 3/45071

FOREIGN PATENT DOCUMENTS

KR 10-2011-0066506 A 6/2011
KR 10-2014-0039828 A 4/2014

* cited by examiner

*Primary Examiner* — Charles V Hicks
(74) *Attorney, Agent, or Firm* — Morgan, Lewis & Bockius LLP

(57) ABSTRACT

The present invention provides a light-emitting display including a display panel, a power supply part, a data driver, a first compensation circuit, and a second compensation circuit. The display panel includes a pixel. The power supply part is connected to a power supply line of the pixel. The data driver is connected to a data line of the pixel. The first compensation circuit section obtains a sensed value through a sensing line of the pixel and obtains a voltage value through the power supply line. The second compensation circuit which generates a compensation value for compensating degradation of an organic light-emitting diode included in the pixel, based on the sensed value and the voltage value.

15 Claims, 13 Drawing Sheets

LIGHT-EMITTING DISPLAY AND METHOD OF DRIVING THE SAME

This application claims the benefit of Korean Patent Application No. 10-2018-0158336, filed on Dec. 10, 2018, which is incorporated herein by reference for all purposes as if fully set forth herein.

BACKGROUND

Technical Field

The present disclosure relates to a light-emitting display and a method of driving the same.

Discussion of the Related Art

The market for displays which act as an intermediary between users and information is growing with the development of information technology. Thus, display devices such as organic light-emitting displays (OLED), and quantum dot displays (QDP), liquid-crystal displays (LCD) are increasingly used.

Some of the aforementioned display devices comprise a display panel comprising sub-pixels, a drive part that outputs driving signals for driving the display panel, and a power supply part that generates electric power to be supplied to the display panel or drive part.

When driving signals, for example, a scan signal and a data signal, are supplied to sub-pixels on the display panel, the aforementioned display devices are able to display an image by allowing the selected sub-pixels to pass light therethrough or to emit light by themselves.

Notably, the light-emitting displays offer many advantages, including electrical and optical characteristics, such as fast response time, high brightness, and wide viewing angle, and mechanical characteristics such as flexibility. However, the light-emitting displays require ongoing research because there is a need for improvement in the configuration of a compensation circuit.

SUMMARY

Accordingly, embodiments of the present disclosure are directed to a display device that substantially obviates one or more of the problems due to limitations and disadvantages of the related art.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

The present invention provides a light-emitting display comprising a display panel, a power supply part, a data driver, a first compensation circuit, and a second compensation circuit. The display panel comprises a pixel. The power supply part is connected to a power supply line of the pixel. The data driver is connected to a data line of the pixel. The first compensation circuit obtains a sensed value through a sensing line of the pixel and obtains a voltage value through the power supply line. The second compensation circuit which generates a compensation value for compensating degradation of an organic light-emitting diode included in the pixel based on the sensed value and the voltage value.

In another aspect, the present invention provides a method of driving a light-emitting display, the method comprising: obtaining a sensed value by charging a parasitic capacitor of an organic light-emitting diode included in a pixel and sensing the charge stored in the parasitic capacitor; obtaining a voltage value by sensing a voltage applied through a power supply line of the pixel; and generating a compensation value for compensating for degradation of the organic light-emitting diode based on the sensed value and the voltage value.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
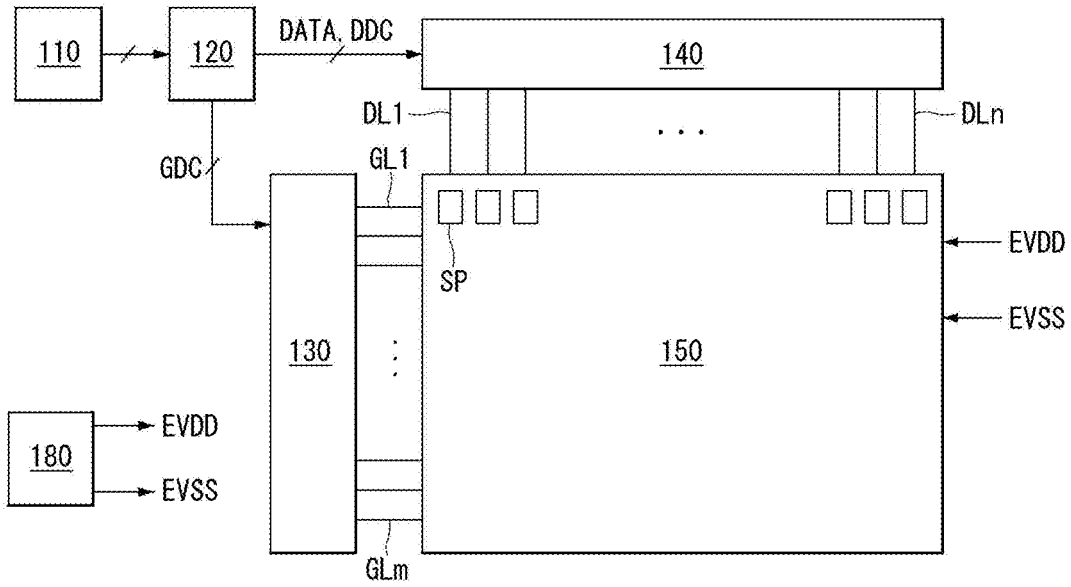
FIG. 1 is a schematic block diagram of an organic light-emitting display according to a first exemplary embodiment of the present invention.

Hereinafter, example embodiments of the present invention will be described with reference to the accompanying drawings.

A light-emitting display according to the present invention may be implemented in televisions, video players, personal computers (PCs), home theaters systems, automotive electronics, smartphones, and so forth, but are not limited to them.

Moreover, a light-emitting display to be described below is applicable to an inorganic light-emitting display device using inorganic light-emitting diodes, as well as an organic light-emitting display device using organic light-emitting diodes. By way of example, the following description will be given of an organic light-emitting display device.

The organic light-emitting display device to be described below performs an image display operation and an external compensation operation. The external compensation operation may be performed for each sub-pixel or for each pixel. The external compensation operation may be performed during a vertical blanking interval in the image display operation, during a power-on sequence before the start of the image display operation, or during a power-off sequence after the end of the image display operation.

The vertical blanking interval is the time during which no data signals for image display are written, between each vertical active period during which 1 frame of data signals is written. The power-on sequence is a transition period from turning on the power for driving the device until displaying an image. The power-off sequence is a transition period from the end of display of an input image until turning off the driving power.

In an external compensation method for performing the external compensation operation, a driving transistor may be operated in a source-follower manner, and then the voltage (the source voltage of the driving TFT) stored in a line capacitor (parasitic capacitor) of a sensing line may be sensed. In the external compensation method, the source voltage may be sensed when the potential at the source node of the driving transistor goes into a saturated state (i.e., the current Ids of the driving TFT becomes zero), in order to compensate for variation in the threshold voltage of the driving transistor. Also, in the external compensation method, linear values may be sensed before the source node of the driving transistor reaches saturation, in order to compensate for variation in the mobility of the driving transistor.

In addition, although sub-pixels to be described below will be illustrated as comprising n-type thin-film transistors by way of example, they may comprise p-type thin-film transistors or both the n-type and p-type transistors. A thin-film transistor is a three-electrode device with gate, source, and drain. The source is an electrode that provides carriers to the transistor. The carriers in the thin-film transistor flow from the source. The drain is an electrode where the carriers leave the thin-film transistor. That is, the carriers in the thin-film transistor flow from the source to the drain.

In the case of the n-type thin-film transistor, the carriers are electrons, and thus the source voltage is lower than the drain voltage so that the electrons flow from the source to the drain. In the n-type thin-film transistor, current flows from the drain to the source. In contrast, in the case of the p-type thin-film transistor, the carriers are holes, and thus the source voltage is higher than the drain voltage so that the holes flow from the source to the drain. In the p-type thin-film transistor, since the holes flow from the source to the drain, current flows from the source to the drain. However, the source and drain of a thin-film transistor are interchangeable depending on the applied voltage. In this regard, in the description below, either the source or drain will be termed a first electrode, and the other will be termed a second electrode.

Figure 2:
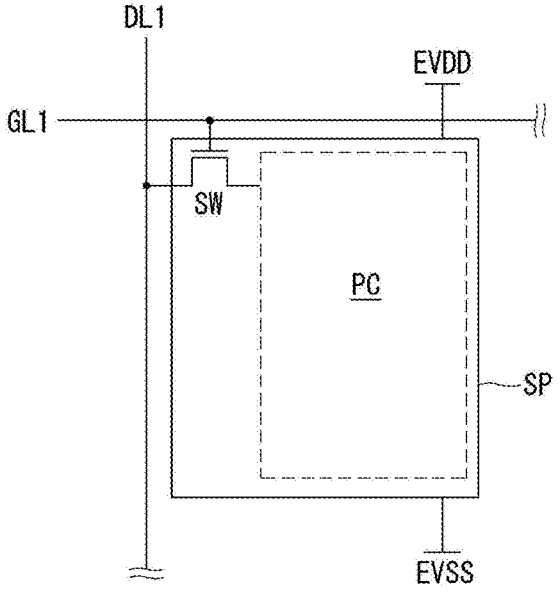
FIG. 2 is a schematic view of the configuration of a sub-pixel shown in FIG. 1.

FIG. 1 is a schematic block diagram of an organic light-emitting display according to a first exemplary embodiment of the present invention. FIG. 2 is a schematic view of the configuration of a sub-pixel shown in FIG. 1.

As shown in FIGS. 1 and 2, the organic light-emitting display according to the first exemplary embodiment of the present invention comprises an image providing part 110, a timing controller 120, a scan driver 130, a data driver 140, a display panel 150, and a power supply part 180.

The image providing part 110 (or host system) outputs various driving signals, along with a video data signal supplied from the outside or a video data signal stored in an internal memory. The image providing part 110 may supply a data signal and various driving signals to the timing controller 120.

The timing controller 120 outputs a gate timing control signal GDC for controlling the operation timing of the scan driver 130, a data timing control signal DDC for controlling the operation timing of the data driver 140, and various synchronization signals (a vertical synchronization signal Vsync and a horizontal synchronization signal Hsync).

The timing controller 120 supplies the data driver 140 with a data signal DATA supplied from the image providing part 110, along with a data timing control signal DDC. The timing controller 120 may be formed in the form of an IC (integrated circuit) and mounted on a printed circuit board, but is not limited thereto.

In response to the gate timing control signal GDC supplied from the timing controller 120, the scan driver 130 outputs a scan signal (or scan voltage). The scan driver 130 supplies a scan signal to sub-pixels included in the display panel 150 through scan lines GL1 to GLm. The scan driver 130 may be formed in the form of an IC (integrated circuit) or directly on the display panel 150 by the gate-in-panel (GIP) technology, but is not limited thereto.

In response to the data timing control signal DDC supplied from the timing controller 120, the data driver 140 samples and latches the data signal DATA, converts it to an analog data voltage corresponding to a gamma reference voltage, and outputs the analog data voltage.

The data driver 140 supplies the data voltage to sub-pixels included in the display panel 150 through data lines DL1 to DLm. The data driver 140 may be formed in the inform of an IC and mounted on the display panel 150 or on a printed circuit board, but is not limited thereto.

The power supply part 180 generates and outputs a high-potential first power EVDD and a low-potential second power EVSS based on an external input voltage supplied from the outside. The power supply part 180 may generate and output a voltage (e.g., scan-high voltage or scan-low voltage) required for driving the scan driver 130 or a voltage (drain voltage or half-drain voltage) required for driving the data driver 140, as well as the first and second powers EVDD and EVSS.

The display panel 150 displays an image, corresponding to the driving signals including the scan signal and data voltage outputted from the drive part comprising the scan driver 130 and data driver 140, and the first and second powers EVDD and EVSS outputted from the power supply part 180. The sub-pixels on the display panel 150 emit light by themselves.

The display panel 150 may be fabricated based on a rigid or flexible substrate of glass, silicon, polyimide, or the like. The sub-pixels which emit light may consist of red, green, and blue pixels, or may consist of red, green, blue, and white pixels.

For example, each sub-pixel SP comprises a pixel circuit PC which comprises a switching transistor SW, a driving transistor, a storage capacitor Cst, and an organic light-emitting diode, etc. The sub-pixels used in the organic light-emitting display have a complex circuit configuration since they emit light by themselves. Also, there are various compensation circuits that compensate for degradation of the organic light-emitting diodes, which emit light, and degradation of the driving transistors, which supply a driving current to the organic light-emitting diodes. As such, it should be noted that the pixel circuit PC in each sub-pixel SP comes in block form.

Although, in the above description, the timing controller 120, scan driver 130, data driver 140, etc. are described as if they were individual components, one or more among the timing controller 120, scan driver 130, and data driver 140 may be integrated in one IC depending on the method of implementation of the organic light-emitting display.

Figure 3:
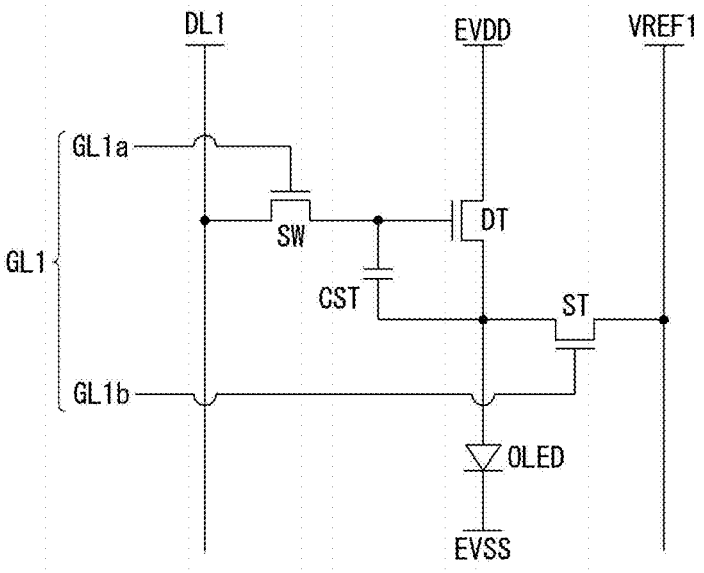
FIG. 3 is an equivalent circuit diagram showing a sub-pixel comprising a compensation circuit according to the first exemplary embodiment of the present invention.
Figure 4:
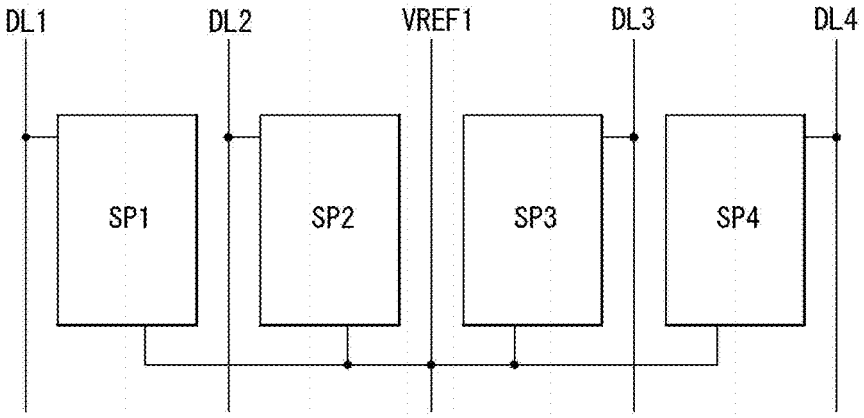
FIGS. 4 and 5 are exemplary views of a pixel that can be implemented based on the sub-pixel of FIG. 3.
Figure 5:
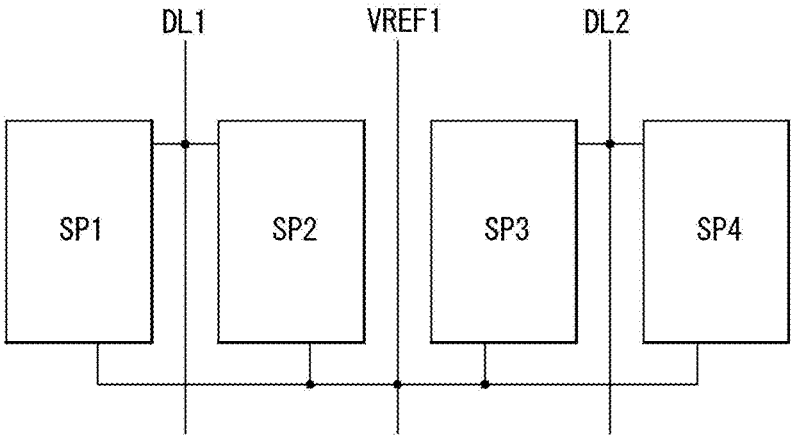

FIG. 3 is an equivalent circuit diagram showing a sub-pixel comprising a compensation circuit according to the first exemplary embodiment of the present invention. FIGS. 4 and 5 are exemplary views of a pixel that can be implemented based on the sub-pixel of FIG. 3.

As shown in FIG. 3, a sub-pixel comprising a compensation circuit according to the first exemplary embodiment of the present invention comprises a switching transistor SW, a sensing transistor ST, a driving transistor DT, a storage capacitor CST, and an organic light-emitting diode OLED.

A gate electrode of the switching transistor SW is connected to a 1A scan line GL1*a*, a first electrode thereof is connected to a first data line DL1, and a second electrode thereof is connected to a gate electrode of the driving transistor DT. The gate electrode of the driving transistor DT is connected to the storage capacitor CST, a first electrode thereof is connected to a first power supply line EVDD, and a second electrode thereof is connected to an anode of the organic light-emitting diode OLED.

A first electrode of the storage capacitor CST is connected to the gate electrode of the driving transistor DT, and a second electrode thereof is connected to the anode of the organic light-emitting diode OLED. The anode of the organic light-emitting diode OLED is connected to the second electrode of the driving transistor DT, and a cathode thereof is connected to a second power supply line EVSS.

A gate electrode of the sensing transistor ST is connected to a 1B scan line GL1*b*, a first electrode thereof is connected to a first sensing line VREF1, and a second electrode thereof is connected to the anode, which is a sensing node, of the organic light-emitting diode OLED. The sensing transistor ST is a compensation circuit added to sense degradation, threshold voltage, etc. in the driving transistor DT and organic light-emitting diode OLED. The sensing transistor ST obtains a sensed value through a sensing node defined between the driving transistor DT and the organic light-emitting diode OLED. The sensed value obtained from the sensing transistor ST is delivered to an external compensation circuit provided outside the sub-pixel through the first sensing line VREF1.

The 1A scan line GL1*a* connected to the gate electrode of the switching transistor SW and the 1B scan line GL1*b* connected to the gate electrode of the sensing transistor ST may be separated from each other as shown in the drawing, or may be connected together. Connecting the gate electrodes together can reduce the number of scan lines, and, as a result, prevent a decrease in aperture ratio caused by the addition of a compensation circuit.

As shown in FIGS. 4 and 5, first to fourth sub-pixels SP1 to SP4 each comprising a compensation circuit according to an exemplary embodiment of the present invention may be defined to form one pixel. The first to fourth sub-pixels SP1 to SP4 may be configured to emit light in red, green, blue, and white, respectively, but are not limited thereto.

As in the first example of FIG. 4, the first to fourth sub-pixels SP1 to SP4 each comprising a compensation circuit may be connected to share one sensing line, i.e., the first sensing line VREF1, and may be connected separately to the first to fourth data lines DL1 to DL4, respectively.

As in the second example of FIG. 5, the first to fourth sub-pixels SP1 to SP4 each comprising a compensation circuit may be connected to share one sensing line, i.e., the first sensing line VREF1, and may be connected in pairs to one data line. For example, the first and second sub-pixels SP1 and SP2 may share the first data line DL1, and the third and fourth sub-pixels SP3 and SP4 may share the second data line DL2.

However, FIGS. 4 and 5 show only two examples, and the present invention may be applicable to a display panel that has sub-pixel structures different than the one illustrated and explained above. Furthermore, the present invention is also applicable to a structure having a compensation circuit within a sub-pixel or a structure having no compensation circuit within a sub-pixel.

Figure 6:
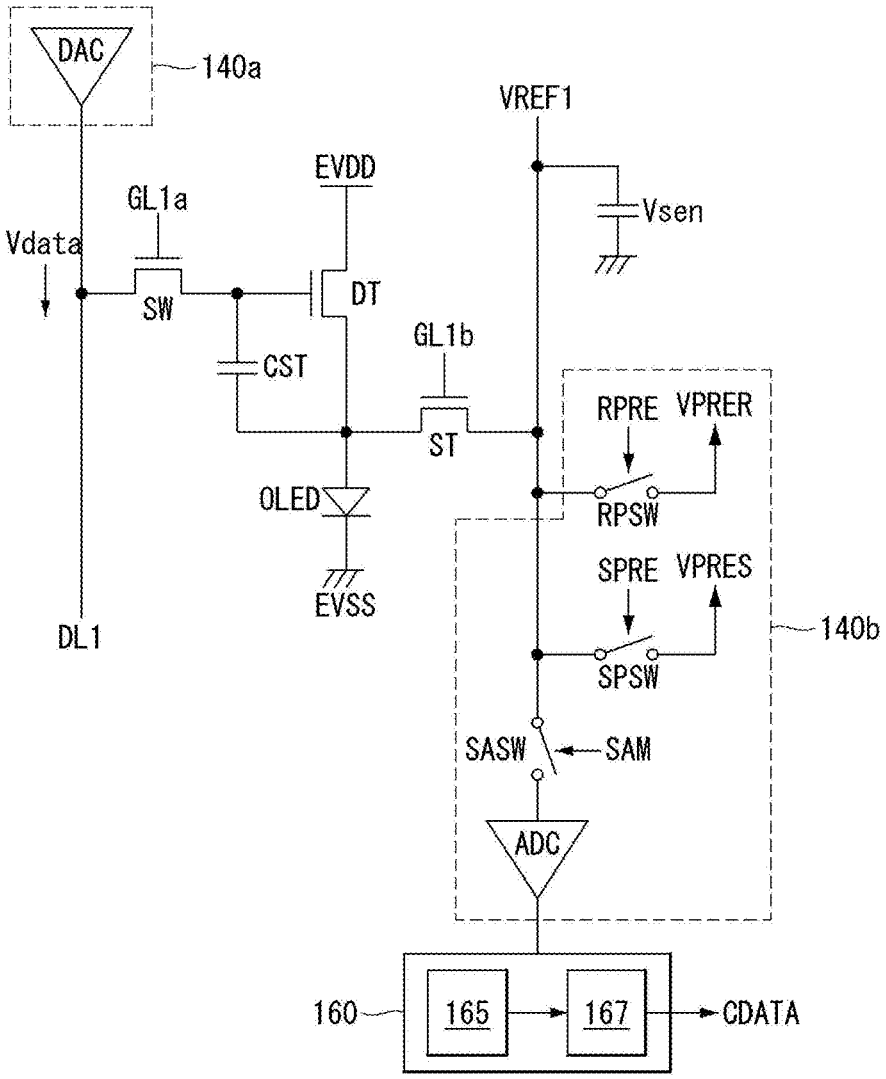
FIG. 6 is a view showing a first example of the main blocks of an organic light-emitting display with a compensation circuit, separately, according to the first exemplary embodiment of the present invention.
Figure 7:
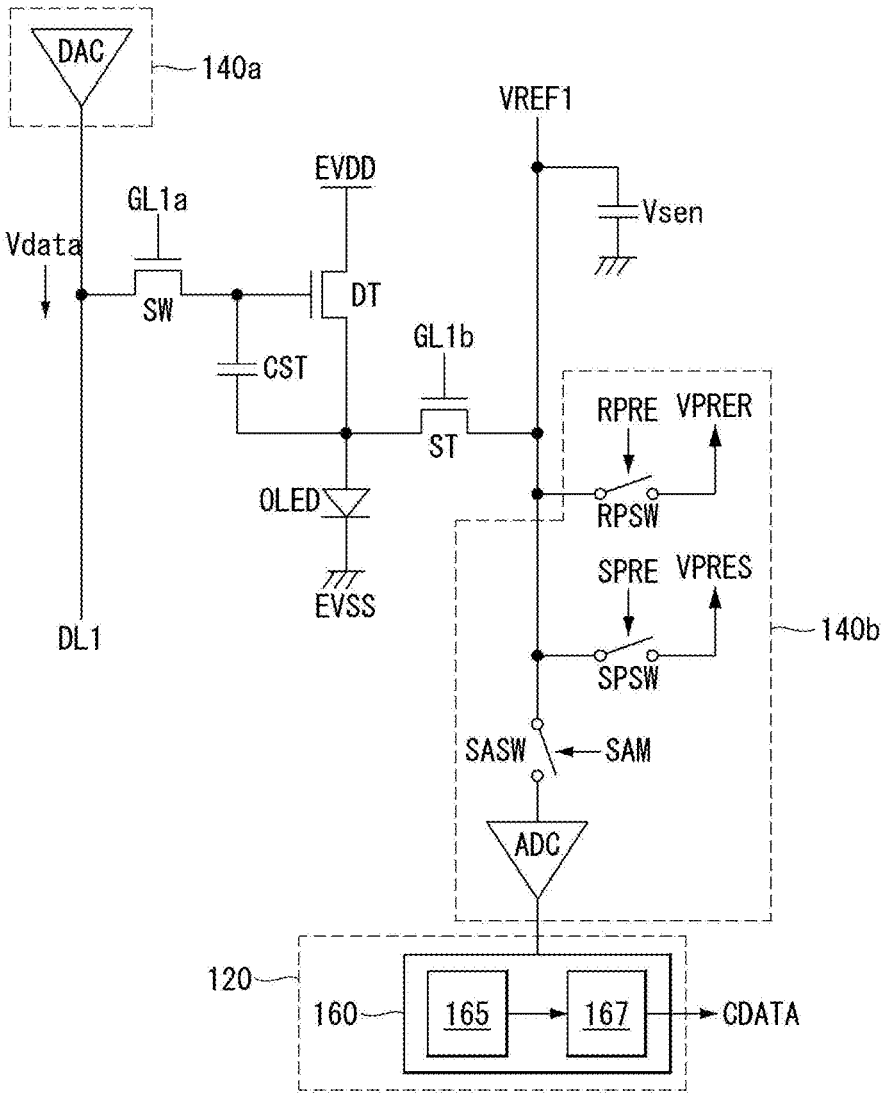
FIGS. 7 and 8 are views showing a second example of the main blocks of an organic light-emitting display with a compensation circuit, separately, according to the first exemplary embodiment of the present invention.
Figure 8:
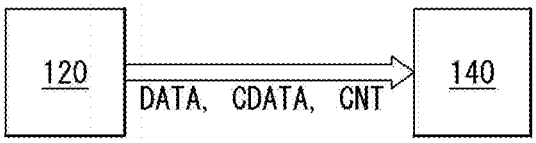

FIG. 6 is a view showing a first example of the main blocks of an organic light-emitting display with a compensation circuit, separately, according to the first exemplary embodiment of the present invention. FIGS. 7 and 8 are views showing a second example of the main blocks of an organic light-emitting display with a compensation circuit, separately, according to the first exemplary embodiment of the present invention.

As shown in FIG. 6, the organic light-emitting display according to the first exemplary embodiment of the present invention comprises a circuit that supplies a data voltage to a sub-pixel, senses an element included in the sub-pixel, and generates a compensation value based on the sensed value.

The data driver 140*a* and 140*b* is a circuit that performs a driving operation such as supplying a data voltage to the sub-pixel and a sensing operation for sensing an element included in the sub-pixel, and may comprise a first circuit

140*a* and a second circuit 140*b*. However, an external compensation circuit such as the second circuit 140*b* may be configured as a separate unit.

The first circuit 140*a* is a circuit that outputs a data voltage Vdata for the driving operation of the sub-pixel, which may comprise a data voltage output part DAC. The data voltage output part DAC converts a digital data signal supplied from the timing controller to an analog voltage and outputs it. An output terminal of the data voltage output part DAC is connected to the first data line DL1. The data voltage output part DAC may output voltages (e.g., black voltage, etc.) required for compensation, as well as data voltages Vdata required for image representation.

The second circuit 140*b* is a circuit that outputs voltages required for sensing and switching operations, which may comprise a reset voltage output switch part SPSW, a driving voltage output switch part RPSW, a sampling switch part SASW, and a sensing circuit part ADC.

The reset voltage output switch part SPSW turns on or off in response to a reset control signal SPRE. The reset voltage output switch part SPSW may output a reset voltage generated by a reset voltage source VPRES through the first sensing line VREF1. The reset voltage generated by the reset voltage source VPRES may be a voltage between a first voltage (high-potential voltage) and a second voltage (low-potential voltage). Typically, the reset voltage is a voltage close to the second voltage. Although the reset voltage output switch part SPSW is illustrated as a simple switch, it is not limited thereto and may be implemented as an active element.

The driving voltage output switch part RPSW turns on or off in response to a driving control signal RPRE. The driving voltage output switch part RPSW may output a driving voltage generated by a driving voltage source VPRER through the first sensing line VREF1. The driving voltage generated by the driving voltage source VPRER may be a voltage between a first voltage (high-potential voltage) and a second voltage (low-potential voltage). Typically, the reset voltage is a voltage close to the second voltage. However, the driving voltage has different voltage levels from the reset voltage.

The sampling switch part SASW turns on or off in response to a sampling control signal SAM. The sampling switching part SASW may sense the characteristics of an element included in the sub-pixel based on the current, voltage, charge stored in the line capacitor Vsen of the first sensing line VREF1. The sampling switch part SASW operates to sense the characteristics of an element, such as the threshold voltage of the organic light-emitting diode OLED and the threshold voltage or mobility of the driving transistor DT, by sampling. Although the sampling switch part SASW is illustrated as a simple switch, it is not limited thereto and may be implemented as an active element.

When the sampling switch SASW is turned on, the sensing circuit part ADC obtains sensed values, corresponding to the threshold voltage of the organic light-emitting element OLED and the threshold voltage or mobility of the driving transistor DT. The sensing circuit part ADC comprises an analog-to-digital conversion circuit part that converts an analog value to a digital value.

A compensation circuit 160 is a circuit that generates a compensation value based on the sensed values, along with image analysis, which may comprise an image analyzer 165 and a compensation value generator 167. The image analyzer 165 may act to analyze the sensed values outputted from the sensing circuit ADC, as well as externally input data signals. The compensation value generator 167 may act to determine the degree of degradation of a sensed element and generate a compensation value required for compensation, corresponding to an analysis result outputted from the image analyzer 165.

As shown in FIGS. 7 and 8, if the first circuit 140*a* and the second circuit 140*b* are included inside the data driver 140, the compensation circuit 160 may be included inside the timing controller 120. Thus, the timing controller 120 may supply the data driver 130 with a compensated data signal CDATA, which is obtained by compensating a data signal DATA based on a compensation value. Also, the timing controller 120 may supply the data driver 140 with a control signal CNT for controlling the second circuit 140*b* and the compensation circuit 160.

Figure 9:
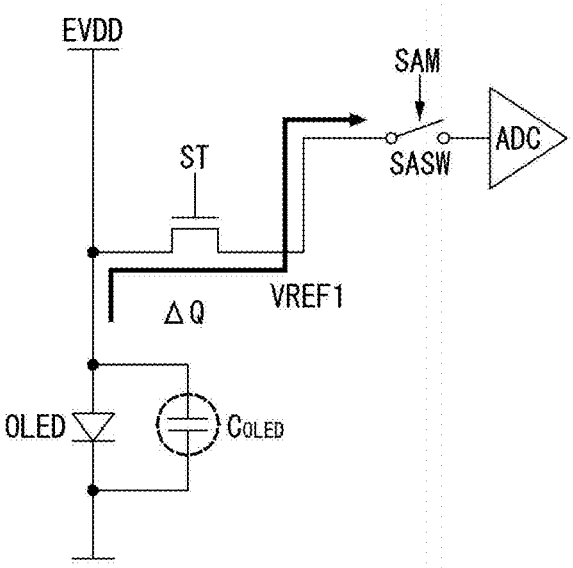
FIG. 9 is a view showing an example of a sensing process of an organic light-emitting display having a compensation circuit according to the first exemplary embodiment of the present invention.
Figure 10:
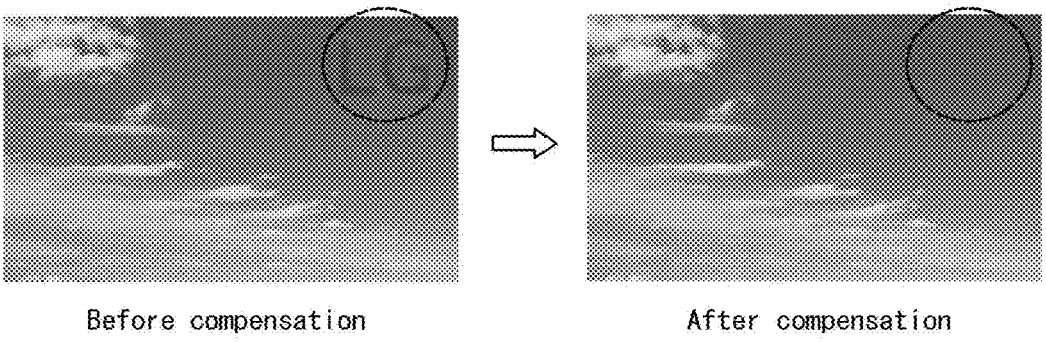
FIG. 10 is an exemplary view of a difference before and after compensation which is detected through the sensing process of FIG. 9.
Figure 11:
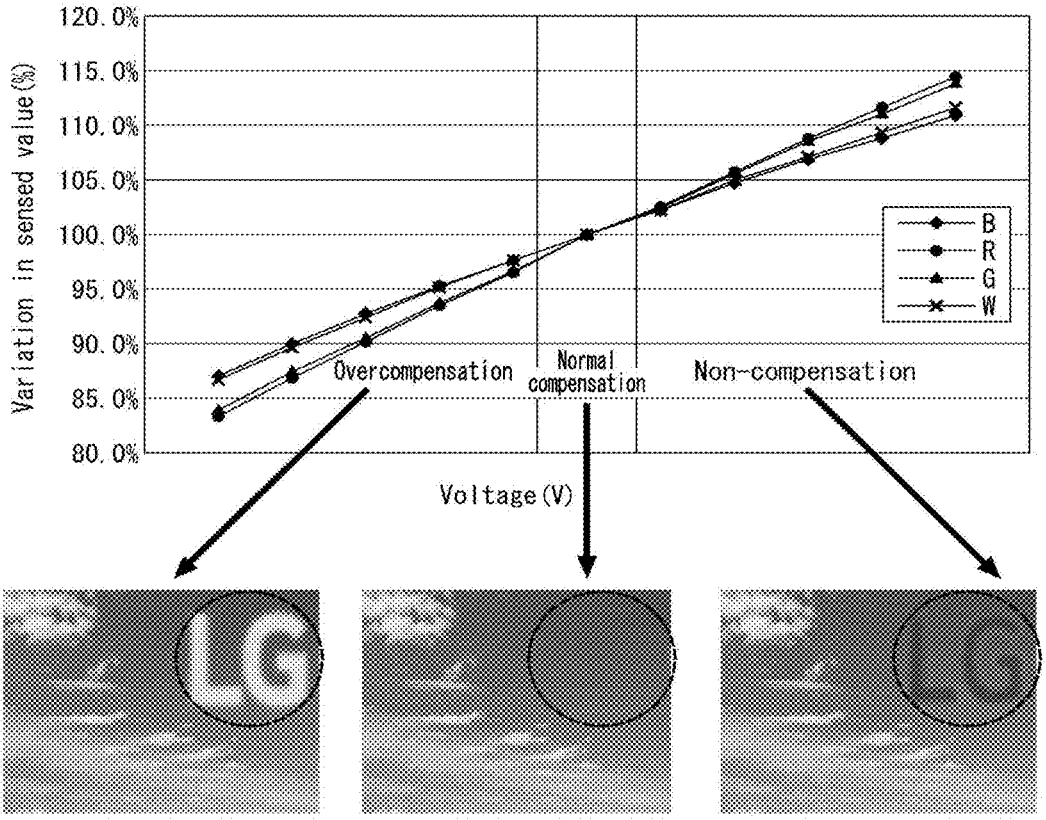
FIG. 11 is an exemplary view for explaining the problems of overcompensation and non-compensation caused by changes in sensed values resulting from changes in first voltage.

FIG. 9 is a view showing an example of a sensing process of an organic light-emitting display having a compensation circuit according to the first exemplary embodiment of the present invention. FIG. 10 is an exemplary view of a difference before and after compensation which is detected through the sensing process of FIG. 9. FIG. 11 is an exemplary view for explaining the problems of overcompensation and non-compensation caused by changes in sensed values resulting from changes in first voltage.

As shown in FIGS. 9 and 10, the organic light-emitting display according to the first exemplary embodiment of the present invention may sense a load AQ present in the parasitic capacitor COLED of the organic light-emitting diode OLED by controlling the sensing transistor ST connected to the first sensing line VREF1. Also, the change caused by degradation of the organic light-emitting diode OLED may be compensated for based on the sensed load AQ. For the change before and after compensation, see FIG. 10.

The change caused by degradation of the organic light-emitting diode OLED may be compensated for based on the load AQ present in the parasitic capacitor COLED of the organic light-emitting diode OLED, because the amount of charge decreases with degradation (Q=CV; the charge Q decreases as the capacitance C decreases) and this relationship can be used for compensation. In this case, any decrease in the amount of current can be detected by analyzing the sensed amount of current.

Meanwhile, in a sensing operation for sensing the load AQ on the organic light-emitting diode OLED, the first voltage EVDD to be stored in the parasitic capacitor COLED has a lower level than in a normal operation of the display panel. That is, in a sensing operation, the first voltage EVDD is varied to have a lower level than in a normal operation.

However, if the output of the first voltage EVDD is not constant (in the case of a non-uniform distribution of the output voltage), the charge AQ stored in the parasitic capacitor COLED also varies as shown in FIG. 11. In this case, it is not possible to accurately sense the change caused by degradation of the organic light-emitting diode OLED, so it is highly likely that the organic light-emitting diode OLED will be overcompensated or non-compensated, rather than being normally compensated. Therefore, there is a need to control or correct the power supply part or take the variation of the first voltage EVDD into account in a compensation operation, so as to keep the output of the first voltage EVDD constant.

Figure 12:
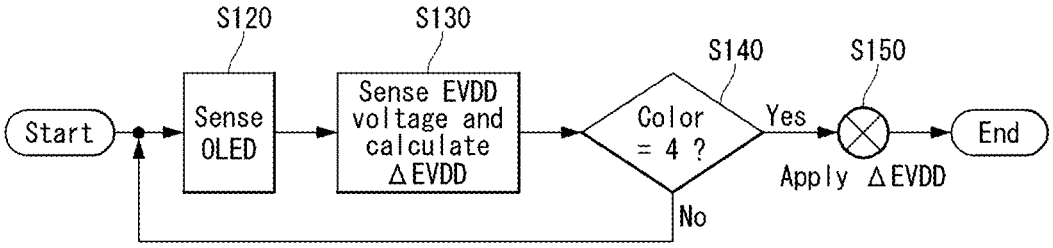
FIGS. 12 and 13 are flowcharts for explaining a first voltage variation compensation method according to the first exemplary embodiment of the present invention.
Figure 13:
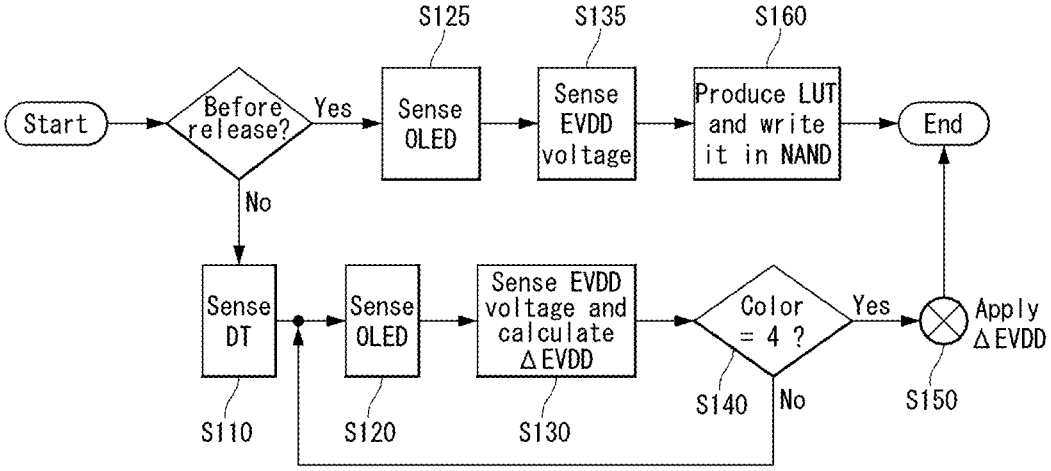

FIGS. 12 and 13 are flowcharts for explaining a first voltage variation compensation method according to the first exemplary embodiment of the present invention.

As shown in FIG. 12, in the first exemplary embodiment of the present invention, the organic light-emitting diode OLED is sensed (S120), and the first voltage EVDD is sensed and the variation ΔEVDD in first voltage is calculated (S130). Then, a gain for the variation ΔEVDD in first voltage (output deviation of the first voltage) is applied to the sensed value of the organic light-emitting diode OLED (S150). Thus, it is possible to obtain a more accurate compensation value for compensating the change caused by degradation of the organic light-emitting diode OLED, because the variation ΔEVDD in first voltage is applied when obtaining the compensation value.

As can be seen from "Color=4?" indicated in "S140", the process for compensating for the variation ΔEVDD in first voltage may be done for the first voltage which is applied to sub-pixels of four colors, including red, green, blue, and white sub-pixels, but is not limited thereto.

As shown in FIG. 13, in the first exemplary embodiment of the present invention, the first voltage EVDD may be sensed (S130), and the gain for the variation ΔEVDD in first voltage from the first voltage EVDD before device shipment (before release) may be applied to the sensed value of the organic light-emitting diode OLED (S150). To this end, a look-up table LUT is generated from values obtained by sensing the organic light-emitting diode OLED (S125) and sensing the first voltage EVDD (S135), and is written in a memory NAND (S160).

Accordingly, degradation compensation (or residual current compensation) may be implemented by sequentially performing a process of measuring a change in the current in the organic light-emitting diode OLED (Δ change in current=reference current−sensed current), a process of retrieving a data value from the look-up table LUT, a process of calculating the gain for the variation ΔEVDD in first voltage, and a process of producing a compensation value based on the values obtained in the previous processes.

Therefore, the method for compensating for degradation of the organic light-emitting diode OLED according to the first exemplary embodiment of the present invention involves performing the first voltage variation compensation method before and after device shipment, a constant amount of current may be sensed from the organic light-emitting diode OLED even if the first voltage EVDD is changed.

Meanwhile, FIG. 13 illustrates that, before device shipment, the driving transistor DT is sensed first (S110) and then the organic light-emitting diode OLED is sensed (S120). However, as opposed to what is shown in the drawing, the first exemplary embodiment of the present invention may be implemented by (1) sensing the organic light-emitting diode OLED first (S120) and then sensing the driving transistor DT (S110). Further, the first exemplary embodiment of the present invention may comprise (2) sensing the driving transistor DT only (S110) or (2) sensing the organic light-emitting diode OLED only. That is, the first exemplary embodiment of the present invention is not limited to the flow of FIG. 12 or FIG. 13.

Figure 14:
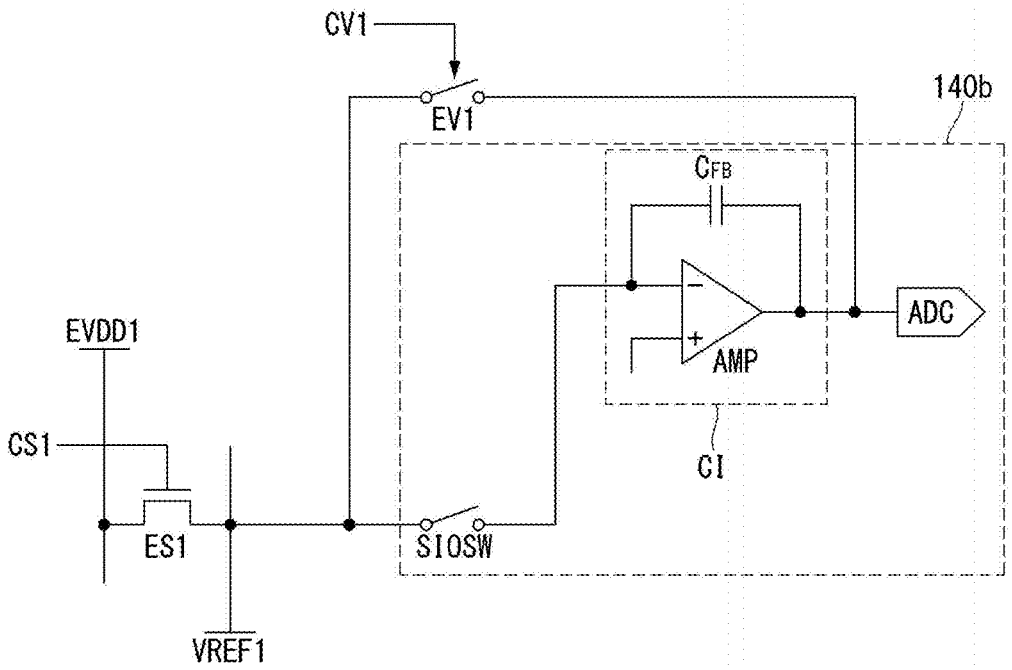
FIG. 14 is a view showing a first voltage variation compensation circuit of an organic light-emitting display with a compensation circuit according to the first exemplary embodiment of the present invention.
Figure 15:
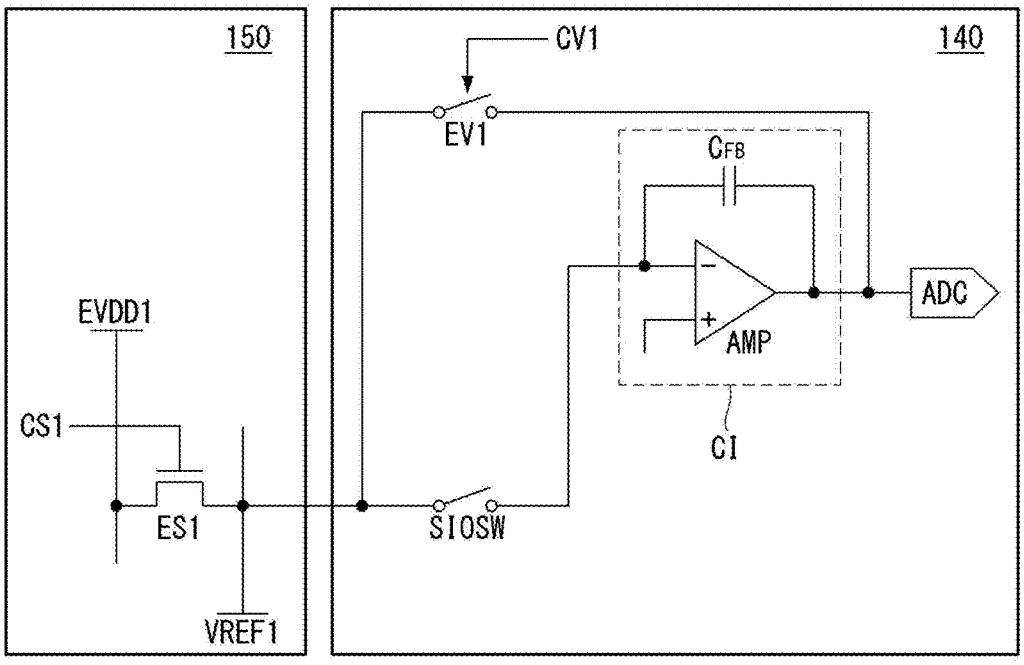
FIG. 15 is a view showing a first voltage variation compensation circuit of an organic light-emitting display with a compensation circuit according to a second exemplary embodiment of the present invention.
Figure 16:
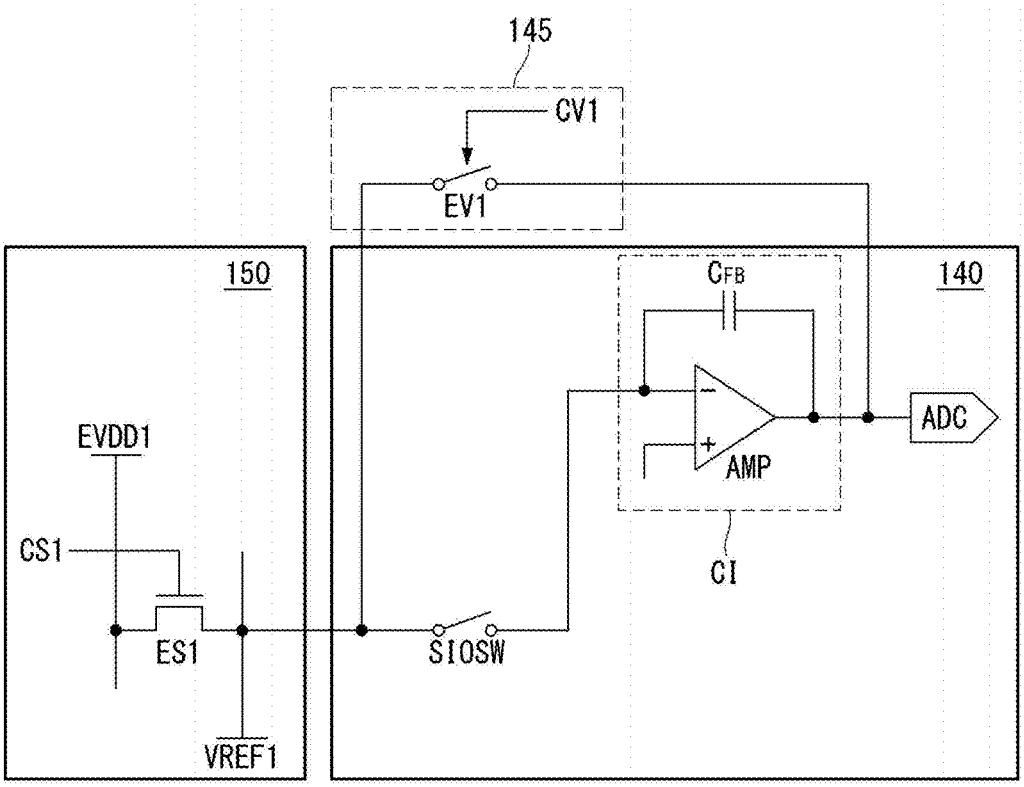
FIG. 16 is a view showing a first voltage variation compensation circuit of an organic light-emitting display with a compensation circuit according to a third exemplary embodiment of the present invention.
Figure 17:
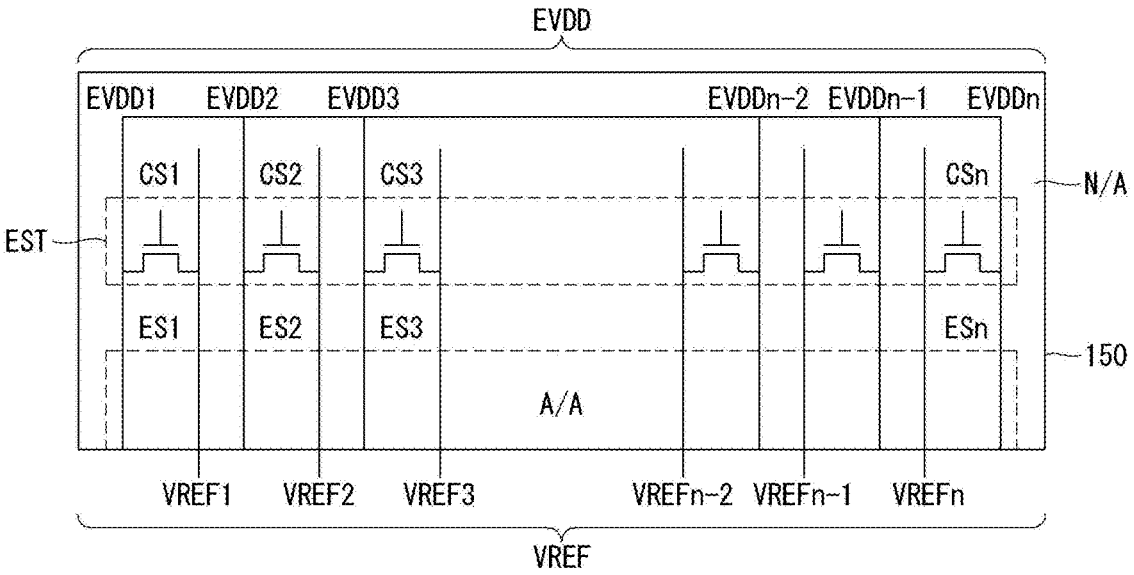
FIG. 17 is an exemplary view of an arrangement of line connecting switches according to the first to third exemplary embodiments of the present invention.

FIG. 14 is a view showing a first voltage variation compensation circuit of an organic light-emitting display with a compensation circuit according to the first exemplary embodiment of the present invention. FIG. 15 is a view showing a first voltage variation compensation circuit of an organic light-emitting display with a compensation circuit according to a second exemplary embodiment of the present invention. FIG. 16 is a view showing a first voltage variation compensation circuit of an organic light-emitting display with a compensation circuit according to a third exemplary embodiment of the present invention. FIG. 17 is an exemplary view of an arrangement of line connecting switches according to the first to third exemplary embodiments of the present invention.

As shown in FIG. 14, the first voltage variation compensation circuit according to the first exemplary embodiment of the present invention comprises a line connecting switch part ES1, a voltage sensing switch part EV1, and a sensing circuit part ADC.

As explained previously with reference to FIGS. 6 and 7, the second circuit 140*b* comprises a sensing circuit part ADC. Further, the second circuit 140*b* comprises a current sensing switch SIOSW, an integrating capacitor CFB, and an op-amp AMP. The integrating capacitor CFB and the op-amp AMP are defined as an integrating circuit part CI for measuring a current by sensing the first sensing line VREF1 and integrating the measured current. It should be noted that the sampling switch part and sample and hold part which are present between the integrating circuit part CI and the sensing circuit part ADC are omitted.

A gate electrode of the line connecting switch part ES1 is connected to a first connection control line CS1, a first electrode thereof is connected to a first power supply line EVDD1, and a second electrode thereof is connected to the first sensing line VREF1. A gate electrode of the voltage sensing switch part EV1 is connected to a first sensing control line CV1, a first electrode thereof is connected to the first sensing line VREF1, and a second electrode thereof is connected to an input terminal of the sensing circuit part ADC. For example, a first connection control signal and a first sensing control signal which are applied respectively through the first connecting control line CS1 and the first sensing control line CV1 may be outputted from the timing controller 120, but are not limited thereto. The input terminal of the sensing circuit part ADC may be selected as an input terminal of the analog-to-digital conversion circuit part.

The line connecting switch part ES1 and the voltage sensing switch part EV1 may be simultaneously turned on, or the line connecting switch part ES1 may be turned on first and then the voltage sensing switch part EV1 may be turned on. Once the line connecting switch part ES1 and the voltage sensing switch part EV1 are turned on, the first voltage applied through the first power supply line EVDD1 is converted from an analog voltage value to a digital voltage value by the sensing circuit part ADC.

As explained previously with reference to FIGS. 6 and 7, the compensation circuit 160 may generate a compensation value based on sensed values, along with image analysis. The compensation circuit 160 receives the sensed value of the organic light-emitting diode and the sensed value of the first voltage. The compensation circuit 160 may detect whether there is any variation ΔEVDD in first voltage based on the sensed value of the first voltage.

The compensation circuit 160 may obtain a compensation value for compensating the change caused by degradation of the organic light-emitting diode OLED (which can lower the possibility of error in sensing and compensating operations), taking into consideration the variation ΔEVDD in first voltage. Once the compensation value for compensating the change caused by degradation of the organic light-emitting diode OLED is obtained, errors in sensing the organic light-emitting diode OLED can be reduced, taking into consideration the variation ΔEVDD in first voltage, thereby preventing and improving overcompensation or non-compensation.

As shown in FIG. 15, according to the second exemplary embodiment of the present invention, the line connecting switch part ES1 may be disposed on the display panel 150, and the voltage sensing switch part EV1, along with the sensing circuit part ADC, etc., may be disposed inside the data driver 140.

In the second exemplary embodiment, like in the first exemplary embodiment, the line connecting switch part ES1 and the voltage sensing switch part EV1 may be simultaneously turned on, or the line connecting switch part ES1 may be turned on first and then the voltage sensing switch part EV1 may be turned on. Once the line connecting switch part ES1 and the voltage sensing switch part EV1 are turned on, the first voltage applied through the first power supply line EVDD1 is converted from an analog voltage value to a digital voltage value by the sensing circuit part ADC. Also, the compensation circuit 160 may obtain a compensation value for compensating for the change caused by degradation of the organic light-emitting diode OLED, taking into consideration the variation ΔEVDD in first voltage.

If the line connecting switch part ES1 is disposed on the display panel 150, as in the second exemplary embodiment of the present invention, even the variation ΔEVDD in first voltage which may occur at the final stage may be taken into consideration, thus providing advantages in terms of accuracy. Moreover, a fewer control lines are needed if the voltage sensing switch part EV1 is disposed inside the data driver 140, which offers advantages in design.

As shown in FIG. 16, according to the third exemplary embodiment of the present invention, the line connecting switch part ES1 may be disposed on the display panel 150, and the voltage sensing switch part EV1 may be disposed on a circuit substrate 145 where the data driver 140 is mounted.

In the third exemplary embodiment, like in the first exemplary embodiment, the line connecting switch part ES1 and the voltage sensing switch part EV1 may be simultaneously turned on, or the line connecting switch part ES1 may be turned on first and then the voltage sensing switch part EV1 may be turned on. Once the line connecting switch part ES1 and the voltage sensing switch part EV1 are turned on, the first voltage applied through the first power supply line EVDD1 is converted from an analog voltage value to a digital voltage value by the sensing circuit part ADC. Also, the compensation circuit 160 may obtain a compensation value for compensating the change caused by degradation of the organic light-emitting diode OLED, taking into consideration the variation ΔEVDD in first voltage.

If the line connecting switch part ES1 is disposed on the display panel 150, as in the third exemplary embodiment of the present invention, even the variation Δ EVDD in first voltage which may occur at the final stage may be taken into consideration, thus providing advantages in terms of accuracy. Moreover, the data driver 140 does not need to be redesigned if the voltage sensing switch part EV1 is disposed on the circuit substrate 145.

As shown in FIG. 17, the line connecting switch part EST in the first to third exemplary embodiments may be disposed in a non-display area N/A on the display panel 150 where no image is displayed. This drawing illustrates, by way of example, that the line connecting switch part EST is disposed in the non-display area N/A, adjacent to a display area A/A where an image is displayed, but not limited thereto.

If a plurality of first power supply lines EVDD and sensing lines VREF are disposed on the display panel 150, the line connecting switch part EST may comprise a plurality of line connecting switches ES1 to ESn. The plurality of line connecting switches ES1 to ESn may be disposed between the plurality of first power supply lines EVDD1 to EVDDn and the plurality of sensing lines VREF1 to VREFn. For example, the first line connecting switch ES1 may be located between the (1-1)th power supply line EVDD1 and the first sensing line VREF1. The Nth line connecting switch ESn may be located between the (1-N)th power supply line EVDDn and the Nth sensing line VREFn. That is, the plurality of line connecting switches ES1 to ESn may be disposed between the plurality of first power supply lines EVDD1 to EVDDn and the plurality of sensing lines VREF1 to VREFn, individually and respectively.

The line connecting switch part EST may be turned on to sense the first voltage transmitted through the (1-1)th power supply line EVDD1 to (1-N)th power supply line EVDDn in forward or reverse order. Also, the line connecting switch part EST may be turned on randomly. Also, only one or more line connecting switches of the line connecting switch part EST may be turned on for block sensing or representative value sensing.

Figure 18:
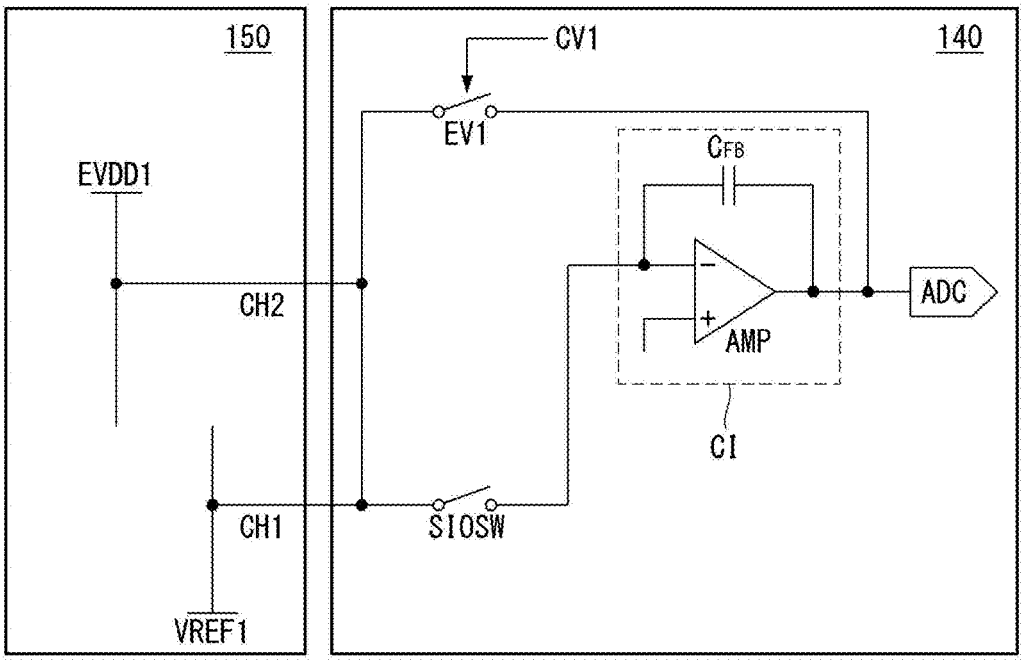
FIG. 18 is a view showing a first voltage variation compensation circuit of an organic light-emitting display with a compensation circuit according to a fourth exemplary embodiment of the present invention.
Figure 19:
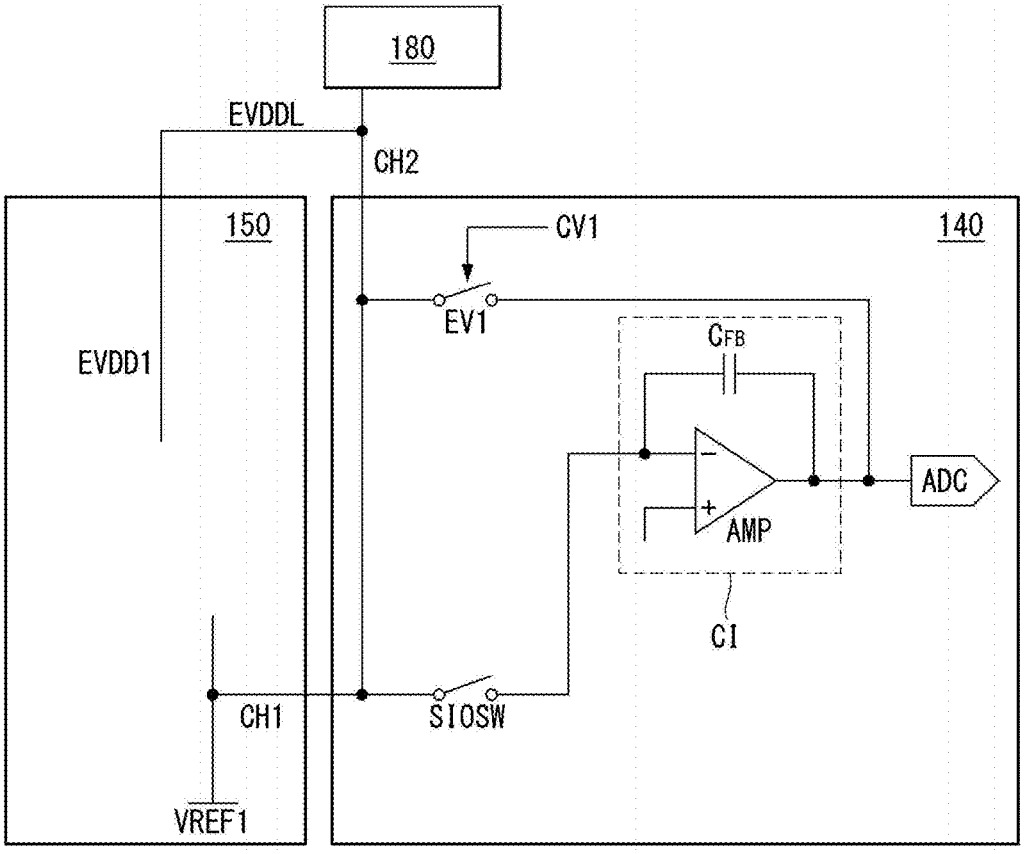
FIG. 19 is a view showing a first voltage variation compensation circuit of an organic light-emitting display with a compensation circuit according to a fifth exemplary embodiment of the present invention.

FIG. 18 is a view showing a first voltage variation compensation circuit of an organic light-emitting display with a compensation circuit according to a fourth exemplary embodiment of the present invention. FIG. 19 is a view showing a first voltage variation compensation circuit of an organic light-emitting display with a compensation circuit according to a fifth exemplary embodiment of the present invention.

As shown in FIG. 18, in the fourth exemplary embodiment of the present invention, the voltage sensing switch part EV1 is included in the data driver 140, the line connecting switch part is eliminated. The data driver 140 comprises a first channel CH1 (current sensing channel) for electrical connection to the first sensing line VREF1 and a second channel CH2 (voltage sensing channel) for electrical connection to the first power supply line EVDD1. In this case, the first power supply line EVDD1 disposed on the display panel 150 is connected directly to the second channel CH2 of the data driver 140.

According to the fourth exemplary embodiment of the present invention, the first power supply line EVDD1 disposed on the display panel 150 is connected to the second channel CH2 of the data driver 140. In the fourth exemplary embodiment of the present invention as well, when the voltage sensing switch part EV1 is turned on, the first voltage applied through the first power supply line EVDD1 is converted from an analog voltage value to a digital voltage value by the sensing circuit part ADC included in the data driver 140. Therefore, it is possible to obtain a compensation value for compensating the change caused by degradation of the organic light-emitting diode by taking into consideration the variation in first voltage.

As in the fourth exemplary embodiment of the present invention, in the case where the line connecting switch part is eliminated, the bezel area issue which may occur in the manufacture of the display panel 150 or the process issue which comes with the formation of the switch part do not need to be taken into consideration. Moreover, a higher degree of design freedom can be achieved in the manufacture of the display panel 150.

As shown in FIG. 19, in the fifth exemplary embodiment of the present invention as well, the voltage sensing switch part EV1 is included in the data driver 140, the line connecting switch part is eliminated. The data driver 140 comprises a first channel CH1 (current sensing channel) for electrical connection to the first sensing line VREF1 and a second channel CH2 (voltage sensing channel) for electrical connection to the first power supply line EVDD1. In this case, an output terminal of the power supply part 180 and the second channel CH2 of the data driver 140 are connected together through a first main power supply line EVDDL.

When the voltage sensing switch part EV1 is turned on, the first voltage applied through the first power supply line EVDD1 is converted from an analog voltage value to a digital voltage value by the sensing circuit part ADC included in the data driver 140. Therefore, it is possible to obtain a compensation value for compensating the change caused by degradation of the organic light-emitting diode by taking into consideration the variation in first voltage.

As in the fifth exemplary embodiment of the present invention, in the case where the line connecting switch part is eliminated, the bezel area issue which may occur in the manufacture of the display panel 150 or the process issue which comes with the formation of the switch part do not need to be taken into consideration. Moreover, a higher degree of design freedom can be achieved in the manufacture of the display panel 150. Additionally, the fifth exemplary embodiment has the advantage of taking into consideration variations caused by changes in the characteristics of the device since the first voltage outputted through the output terminal of the power supply part 180 can be directly sensed.

As seen from above, in the present invention, display quality can be improved by increasing the accuracy of sensing and compensating for degradation of the organic light-emitting diode, and, at the same time, the device's lifespan can be lengthened by preventing overcompensation or non-compensation. Moreover, the present invention offers the advantage of preventing and improving overcompensation or non-compensation by taking into consideration a non-uniform voltage distribution caused by a drop in power supply voltage or output irregularities, when sensing and compensating for degradation of the organic light-emitting diode. Furthermore, the present invention offers the advantage of lowering the possibility of error in sensing and compensating operations.

It will be apparent to those skilled in the art that various modifications and variations can be made in the light-emitting display and method of driving the same of the present disclosure without departing from the technical idea or scope of the disclosure. Thus, it is intended that the present disclosure cover the modifications and variations of this disclosure provided they come within the scope of the appended claims and their equivalents.

What is claimed is:

1. A light-emitting display, comprising:

a display panel comprising a pixel, the pixel comprising:
- an organic light-emitting diode; and
- a driving transistor configured to supply a driving current to the organic light-emitting diode, the driving transistor comprising:
  - a first electrode connected to a power supply line; and
  - a second electrode connected to an anode of the organic light-emitting diode;

a power supply part connected to the power supply line of the pixel;

a data driver connected to a data line of the pixel;

a first compensation circuit configured to:
- obtain a sensed value through a sensing line of the pixel; and
- obtain a voltage value through the power supply line; and a second compensation circuit configured to generate a compensation value for compensating degradation of an organic light-emitting diode included in the pixel, based on the sensed value and the voltage value.

2. The light-emitting display of claim 1, wherein the second compensation circuit is further configured to:
- calculate a gain for an output variation in the voltage outputted from the power supply part based on the voltage value; and apply the gain in the compensation value.

3. The light-emitting display of claim 1, further comprising a voltage sensing switch part disposed between the sensing line and the first compensation circuit, the voltage sensing switch part being configured to transmit the voltage value obtained through the sensing line to an input terminal of the first compensation circuit.

4. The light-emitting display of claim 3, further comprising a line connecting switch part disposed between the power supply line and the sensing line, the line connecting switch part being configured to measure the voltage flowing through the power supply line.

5. The light-emitting display of claim 4, wherein the line connecting switch part is disposed in a non-display area on the display panel where no image is displayed.

6. The light-emitting display of claim 3, wherein the voltage sensing switch part is included in the first compensation circuit.

7. The light-emitting display of claim 3, wherein the voltage sensing switch part is located on a circuit substrate where the first compensation circuit is mounted.

8. The light-emitting display of claim 5, wherein the line connecting switch part comprises a plurality of line connecting switches respectively disposed between a plurality of power supply lines and a plurality of sensing lines.

9. The light-emitting display of claim 4, wherein:
- the voltage sensing switch part and the line connecting switch part are simultaneously turned on; or
- the line connecting switch part is turned on first and then the voltage sensing switch part is turned on.

10. The light-emitting display of claim 9, wherein, when the voltage sensing switch part and the line connecting switch part are turned on, the voltage applied through the power supply line is converted from an analog voltage value to a digital voltage value.

11. The light-emitting display of claim 8, wherein the plurality of line connecting switches is turned on in forward order, in reverse order, or in random order.

12. The light-emitting display of claim 1, wherein the data driver comprises:
- the first compensation circuit;
- a first channel connected to the sensing line, the first channel being configured to obtain the sensed value; and
- a second channel connected to the power supply line, the second channel being configured to obtain the voltage value.

13. The light-emitting display of claim 1, wherein the data driver comprises:
- the first compensation circuit;
- a first channel connected to the sensing line, the first channel being configured to obtain the sensed value; and
- a second channel connected to an output terminal of the power supply line, the second channel being configured to obtain the voltage value.

14. A method of driving a light-emitting display, the method comprising:

obtaining a sensed value by charging a parasitic capacitor of an organic light-emitting diode included in a pixel and sensing the charge stored in the parasitic capacitor, the pixel comprising:

the organic light-emitting diode; and a driving transistor configured to supply a driving current to the organic light-emitting diode, the driving transistor comprising:

a first electrode connected to a power supply line; and a second electrode connected to an anode of the organic light-emitting diode;

obtaining a voltage value by sensing a voltage applied through the power supply line of the pixel; and generating a compensation value for compensating degradation of the organic light-emitting diode based on the sensed value and the voltage value.

15. The method of claim 14, wherein, in the compensation value generating operation:

a gain for an output deviation of the voltage is calculated based on the voltage value; and the gain is applied in the compensation value.

* * * * *